United States Patent [19]

Miki et al.

[11] Patent Number: 4,481,927

[45] Date of Patent: Nov. 13, 1984

[54] APPARATUS FOR SUPPLYING FUEL INTO AN INTERNAL COMBUSTION ENGINE

[75] Inventors: Takao Miki; Yoshiaki Asayama, both of Hyogo, Japan

[73] Assignee: Mitsubishi Denki Kabushiki Kaisha, Tokyo, Japan

[21] Appl. No.: 486,284

[22] PCT Filed: Aug. 10, 1982

[86] PCT No.: PCT/JP82/00314

§ 371 Date: Mar. 22, 1983

§ 102(e) Date: Mar. 22, 1983

[87] PCT Pub. No.: WO83/00533

PCT Pub. Date: Feb. 17, 1983

[30] Foreign Application Priority Data

Aug. 11, 1981 [JP] Japan ..... 56-126968

[51] Int. Cl.[3] ..... F02B 3/00

[52] U.S. Cl. ..... 123/478; 123/494; 123/492

[58] Field of Search ..... 123/494, 478, 492, 472

[56] References Cited

U.S. PATENT DOCUMENTS

| | | | |
|---|---|---|---|
| 4,121,549 | 10/1978 | Martin | 123/478 |
| 4,140,088 | 2/1979 | Vulpillieres | 123/478 |
| 4,256,075 | 3/1981 | Fukui | 123/478 |
| 4,269,157 | 5/1981 | Fujishiro | 123/478 |
| 4,409,929 | 10/1983 | Sasaki | 123/494 |
| 4,424,785 | 1/1984 | Ishida | 123/478 |

FOREIGN PATENT DOCUMENTS

| | | | |
|---|---|---|---|
| 1542869 | 3/1979 | United Kingdom | 123/478 |
| 2027942 | 2/1980 | United Kingdom | 123/478 |
| 2040357 | 8/1980 | United Kingdom | 123/478 |
| 2048522 | 12/1980 | United Kingdom | 123/478 |

*Primary Examiner*—Ronald B. Cox

*Attorney, Agent, or Firm*—Sughrue, Mion, Zinn, Macpeak & Seas

[57] ABSTRACT

This invention ensures stability in the idling operation of an engine and an improvement in its acceleration performance, since it includes a second electromagnetic valve 6 for injecting synchronously with the rotatory speed of the engine the quantity of fuel calculated in accordance with an input corresponding to the rotatory speed of the engine, in addition to a first electromagnetic valve 5 for injecting fuel synchronously with the frequency output of a vortex flow meter 4 which detects the quantity of air drawn into the engine.

2 Claims, 1 Drawing Figure

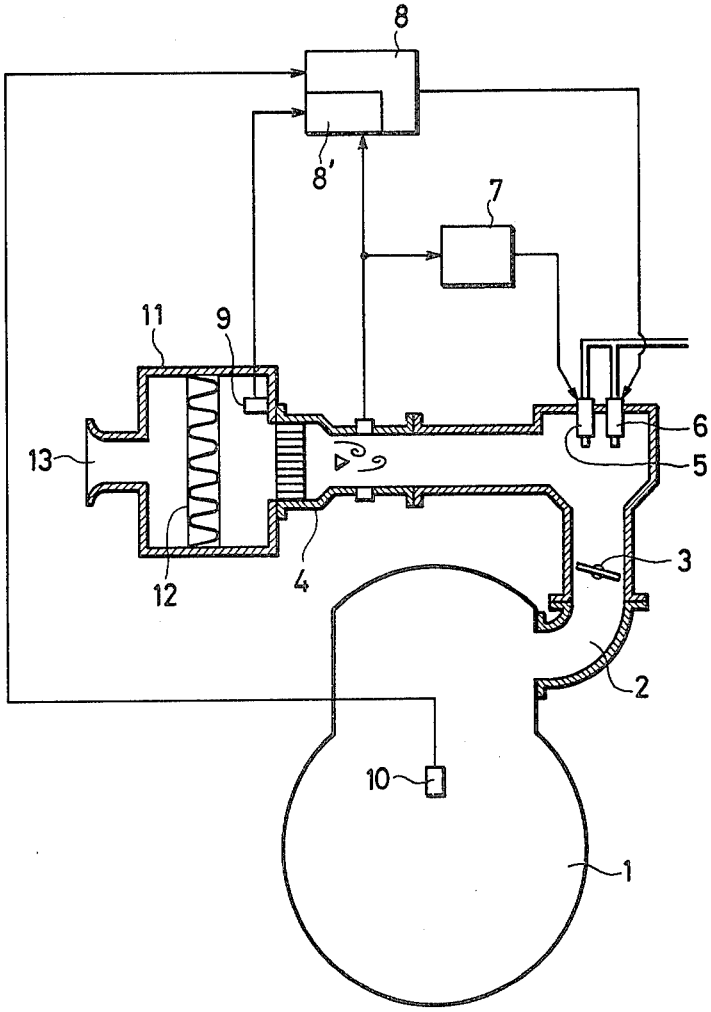
8
8'
7
11
9
13
6
5
3
12
4
2
10
1

APPARATUS FOR SUPPLYING FUEL INTO AN INTERNAL COMBUSTION ENGINE

TECHNICAL FIELD

This invention relates to an apparatus for supplying fuel into an internal combustion engine for an automobile. More particularly, it is concerned with an apparatus for supplying fuel into an internal combustion engine, which comprises a vortex flow meter for detecting the quantity of air drawn into the engine, a first electromagnetic valve adapted to be driven for a predetermined length of time synchronously with the frequency output of the vortex flow meter to inject fuel, and a second electromagnetic valve adapted to be driven responsive to the rotatory speed of the engine to inject fuel in a quantity corrected to suit the operating condition of the engine.

BACKGROUND ART

A vortex flow meter provides a frequency output corresponding to the vortical speed (number of vortexes formed) which is proportional to the quantity of air to be measured. A method for injecting a predetermined quantity of fuel into an engine synchronously with the frequency output which is proportional to the quantity of air drawn thereinto has been proposed in Unexamined Utility Model Publication No. 133919/1978 or Unexamined patent publication No. 5448/1980. This method has the disadvantage that a lower frequency of fuel injection is likely to bring about changes in rotation during the idling operation of the engine during which only a smaller quantity of air is drawn thereinto, particularly when the engine is of the multicylinder type. On the other hand, a prior method which injects fuel in accordance with the rotatory speed of the engine stabilizes the idling operation, since it enables the uniform supply of fuel to all the cylinders even during the idling operation during which only a smaller quantity of air is drawn into the engine. The method of injecting fuel in accordance with the frequency output proportional to the quantity of air drawn into the engine, however, improves the acceleration performance of the engine, since it enables the injection of fuel without any appreciable delay when the quantity of air has been changed. On the other hand, the method of injecting fuel in accordance with the rotatory speed of the engine lowers its acceleration performance, since an increase in its rotatory speed takes place with a certain amount of delay after the quantity of air drawn thereinto has been changed.

DISCLOSURE OF THE INVENTION

This invention provides an apparatus for supplying fuel into an internal combustion engine which includes a first electromagnetic valve for injecting fuel synchronously with the frequency output which is proportional to the quantity of air drawn into the engine, and a second electromagnetic valve for injecting fuel synchronously with the rotatory speed of the engine, and which eliminates the drawbacks of the known systems as hereinabove pointed out.

More specifically, this invention provides an apparatus which enables stabilization of the idling operation of a multicylinder engine and an improvement in its acceleration performance, since it comprises a vortex flow meter (4) generating a frequency output corresponding to a vortical speed proportional to the quantity of air drawn into the engine whereby the quantity of air drawn into the engine is detected, a first electromagnetic valve (5) driven for a predetermined length of time synchronously with the frequency output of the vortex flow meter (4) to inject fuel, an operating unit (8') for calculating the input corresponding to the frequency output of the vortex flow meter (4) and the temperature of the air drawn into the engine, and determining the quantity of fuel injection corresponding to the rotatory speed of the engine, and a second electromagnetic valve (6) for injecting synchronously with the rotatory speed of the engine the quantity of fuel determined by the operating unit (8'). If the second electromagnetic valve (6) is so designed as to supply a quantity of fuel corrected to suit the air temperature, engine temperature, atmospheric pressure, air-fuel ratio feedback control, etc., the time required for the calculation of the corrected fuel quantity does not result in any lowered acceleration performance of the engine.

BRIEF DESCRIPTION OF THE DRAWING

FIG. 1 is a schematic view showing a preferred embodiment of this invention.

BEST MODE FOR CARRYING OUT THE INVENTION

The invention will now be described in further detail with reference to the accompanying drawing.

FIG. 1 is a schematic view of an apparatus for supplying fuel into an internal combustion engine according to a preferred embodiment of this invention. In the drawing, numeral 1 designates an engine, and 2, an intake pipe for the engine 1. A throttle valve 3 is operationally associated with an acceleration pedal on a motor vehicle. A vortex flow meter 4 is provided for detecting the quantity of air drawn into the engine 1. A first electromagnetic valve 5 is provided upstream of the throttle valve for injecting fuel for a predetermined length of time synchronously with the frequency output of the vortex flow meter 4. A second electromagnetic valve 6 is provided for injecting fuel for a predetermined length of time synchronously with the rotatory speed of the engine 1. The first and second electromagnetic valves 5 and 6 inject into the intake pipe 2 the fuel supplied under pressure from a fuel pump not shown. A first electromagnetic valve driving circuit 7 is provided for driving the first electromagnetic valve 5 synchronously with the frequency output of the vortex flow meter 4. The first electromagnetic valve 5 injects a half of the fuel required by the engine, while the other half is supplied through the second electromagnetic valve 6. An electronic control device 8 is provided for driving the second electromagnetic valve 6, and includes an operating unit 8' which receives the output signals of an air temperature detector 9, a rotatory speed detector 10 and the vortex flow meter 4 and determines the quantity of fuel injection corresponding to the rotatory speed of the engine 1. An air cleaner 11 is provided upstream of the vortex flow meter 4 and contains a cleaner element 12 (filter paper). The air cleaner is provided with a duct 13 through which air is drawn thereinto.

Description will now be made of the operation of the apparatus constructed as hereinabove described. Changes are likely to occur in the rotation of the engine during its idling operation during which only a small quantity of air is drawn thereinto, resulting in a lower frequency output of the vortex flow meter 4 and a longer interval of time between the injections of fuel through the first electromagnetic valve 5. These changes due to the intermittent injection of fuel by the first electromagnetic valve 5 can, however, be reduced by the uniform distribution of fuel to all the cylinders of the engine 1, since a half of the fuel required by the engine is supplied through the second electromagnetic valve 6 synchronously with its rotatory speed. If the throttle valve 3 is opened rapidly to accelerate the engine, the quantity of air drawn thereinto is increased with a resultant increase in the frequency output of the vortex flow meter 4, and the first electromagnetic valve 5 supplies fuel in an increased quantity corresponding to the increased quantity of air. Accordingly, there is no substantial delay in the supply of fuel after the quantity of air has increased. The second electromagnetic valve 6 supplies fuel with a considerable delay after the opening of the throttle valve 3, since the quantity of its fuel injection is determined in accordance with the rotatory speed of the engine based on the output signals of the air temperature detector 9, the rotatory speed detector 10 and the vortex flow meter 4, and since the rotatory speed of the engine cannot be increased in accordance with an increase in the quantity of air drawn thereinto. This delay is, however, made up by the supply of fuel through the first electromagnetic valve 5, and therefore, it is possible to prevent any reduction in the acceleration performance of the engine 1 due to any such delay in the supply of fuel.

INDUSTRIAL UTILITY

The apparatus of this invention for supplying fuel into an internal combustion engine is useful for controlling in accordance with the operating condition of a vehicle the quantity of fuel relative to the quantity of air drawn thereinto.

We claim:

1. An apparatus for supplying fuel into an internal combustion engine, comprising a vortex flow meter for detecting the quantity of air drawn into the engine, a first electromagnetic valve adapted to be driven for a predetermined length of time synchronously with the frequency output of said vortex flow meter to inject fuel, an operating unit for calculating an input corresponding to at least the frequency output of said vortex flow meter and temperature, and determining the quantity of fuel corresponding to the rotatory speed of the engine, and a second electromagnetic valve for injecting synchronously with the rotatory speed of the engine the quantity of fuel determined by said operating unit.

2. An apparatus as set forth in claim 1, wherein said second electromagnetic valve supplies fuel in a quantity corrected in accordance with the operating condition of the engine.

* * * * *